US005465027A

United States Patent [19]

Ishizuka et al.

[11] Patent Number: 5,465,027

[45] Date of Patent: Nov. 7, 1995

[54] CHIP-IN-GLASS FLUORESCENT INDICATOR PANEL WITH HEAT PROTECTION

[75] Inventors: Mitsuhiro Ishizuka; Hiroshi Saeki, both of Tokyo, Japan

[73] Assignee: NEC Corporation, Japan

[21] Appl. No.: 56,296

[22] Filed: Apr. 30, 1993

[30] Foreign Application Priority Data

May 7, 1992 [JP] Japan ..... 4-114387

[51] Int. Cl.[6] ..... H01J 1/88

[52] U.S. Cl. ..... 313/517; 313/496

[58] Field of Search ..... 313/517, 496

[56] References Cited

U.S. PATENT DOCUMENTS

| | | | |
|---|---|---|---|
| 4,084,114 | 4/1978 | Kuroda et al. | 313/517 |
| 4,122,376 | 10/1978 | Mera et al. | 313/496 |
| 4,164,683 | 8/1979 | Nakamura et al. | 313/496 |
| 4,788,472 | 11/1988 | Katakami | 313/496 |
| 4,899,081 | 2/1990 | Kishino et al. | 313/496 |
| 4,950,193 | 8/1990 | Jang | 445/24 |
| 5,235,245 | 8/1993 | Uchimura et al. | 313/496 |
| 5,270,613 | 12/1993 | Kim | 313/496 |

OTHER PUBLICATIONS

M. Tanahashi, et al., "Pl.3 New Fluorescent Indicator Panels Having IC Driver Chips in the Panel Envelope", Japan Display 1986, pp. 120–123.

*Primary Examiner*—Sandra L. O'Shea
*Assistant Examiner*—Vip Patel
*Attorney, Agent, or Firm*—Laff, Whitesel, Conte & Saret, Ltd.

[57] ABSTRACT

A chip-in-glass fluorescent indicator panel includes a glass substrate, a wiring layer, an insulating layer, a pattern-like graphite layer, a phosphor layer, a filament, a grid, an IC, an IC shield, a filament fixing portion, and an anchor. The wiring layer is formed on the glass substrate. The insulating layer covers the wiring layer. The pattern-like graphite layer is formed on the insulating layer to be electrically connected to the wiring layer. The phosphor layer is formed on the pattern-like graphite layer. The filament is suspended above phosphor layer with an interval. The grid is arranged between the filament and the phosphor layer. The IC is fixed on the insulating layer on one end side of the glass substrate to be connected to the pattern-like graphite layer through the wiring layer. The IC shield is arranged between the IC and the filament. The filament fixing portion is formed on the IC shield. The anchor is arranged on the insulating layer on the other end side of the glass substrate to suspend the filament between the anchor and the filament fixing portion.

4 Claims, 6 Drawing Sheets

CHIP-IN-GLASS FLUORESCENT INDICATOR PANEL WITH HEAT PROTECTION

BACKGROUND OF THE INVENTION

The present invention relates to a chip-in-glass fluorescent indicator panel and, more particularly, to a chip-in-glass fluorescent indicator panel in which an IC shield arranged for protecting an IC and a filament fixing portion are integrated with each other.

In the structure of a conventional chip-in-glass fluorescent indicator panel, as shown in FIGS. 5 and 6, a wiring layer 1 formed by sputtering Al or printing Ag is formed on a glass substrate 17 consisting of soda-lime glass, at least one insulating layer 7 is formed by screen printing on the wiring layer 1 to prevent a pattern-like graphite layer 2 from being short-circuited to the wiring layer 1. In the insulating layer 7, holes for electrically connecting the pattern-like graphite layer 2 to the wiring layer 1, holes for connecting bonding pads on an IC 3 to bonding pads 4 on the substrate by bonding wires 5, and holes for connecting the wiring layer 1 to terminals 6 arranged for electrically connecting the internal circuit of a glass envelope 15 to an external circuit are formed. In these holes, the holes for electrically connecting the pattern-like graphite layer 2 to the wiring layer 1 are filled with graphite 8 to electrically connect the pattern-like graphite layer 2 to the wiring layer 1. The pattern-like graphite layer 2 is formed by screen printing on the insulating layer 7. In addition, a phosphor layer 9 is formed on the pattern-like graphite layer 2 by screen printing, photolithography, or the like.

A die bonding material is coated on the insulating layer 7 by using stamp pins or the like, and the IC 3 is mounted on the die bonding material. The IC 3 is fixed by curing the die bonding material, and the bonding pads on the IC 3 are connected to the bonding pads 4 on the substrate by the bonding wires 5. An IC shield 10 for preventing hot electrons emitted from a coating layer 14 of a filament 12 from being injected in the IC 3 and preventing an erroneous operation is formed on the IC 3, and a grid 11 for controlling the hot electrons from the coating layer 14 of the filament 12 is formed above the phosphor layer 9 of the pattern-like graphite layer 2. In addition, the filament 12 having a surface coated with the ternary carbonate coating layer 14 is suspended by an anchor 13 and a filament fixing portion 16 above the phosphor layer 9, the grid 11, the IC 3, and the IC shield 10. In order to easily fix the filament 12 to the anchor 13 and the filament fixing portion 16, the coating layer 14 is pealed to expose a core line at both the ends of the filament 12. These elements are assembled together with a glass envelope 15. The resultant structure is subjected to a sealing and evacuating processes to evacuate the glass envelope 15, thereby completing a chip-in-glass fluorescent indicator panel.

In the conventional chip-in-glass fluorescent indicator panel, since the IC is present between the phosphor layer 9 and the filament fixing portion 16, the long filament 12 must be stretched between the filament fixing portion 16 and the anchor 13. For this reason, a drive voltage of the filament 12 is higher than that of a normal fluorescent indicator panel. When the filament 12 is particularly driven at a low DC voltage, e.g., an anode-grid voltage of 12V or less, an anode-grid RMS voltage on the positive side of the filament 12 is decreased, thereby resulting in an insufficient luminance.

As the filament fixing portion 16 and the anchor 13 must be arranged outside the IC shield 10, the size of the package must be increased. The IC shield 10 and the filament 12 must have a sufficient interval therebetween to prevent the IC shield 10 from being in contact with the filament 12 because this contact peals the coating layer 14 of the filament 12 to expose the core line. Therefore, the luminance is disadvantageously decreased by the long interval.

SUMMARY OF THE INVENTION

It is an object of the present invention to provide a chip-in-glass fluorescent indicator panel capable of obtaining a high luminance at a low voltage.

It is another object of the present invention to provide a chip-in-glass fluorescent indicator panel having a compact package.

In order to achieve the above objects, according to the present invention, there is provided a chip-in-glass fluorescent indicator panel comprising a glass substrate, a wiring layer formed on the glass substrate, an insulating layer for covering the wiring layer, a pattern-like graphite layer formed on the insulating layer to be electrically connected to the wiring layer, a phosphor layer formed on the pattern-like graphite layer, a filament suspended above the phosphor layer with an interval, a grid arranged between the filament and the phosphor layer, an IC fixed on the insulating layer on one end side of the glass substrate to be connected to the pattern-like graphite layer through the wiring layer, an IC shield arranged between the IC and the filament, a filament fixing portion formed on the IC shield, and an anchor, arranged on the insulating layer on the other end side of the glass substrate, for suspending the filament between the anchor and the filament fixing portion.

DESCRIPTION OF THE PREFERRED EMBODIMENTS

Embodiments of the present invention will be described below with reference to the accompanying drawings.

Figure 1:
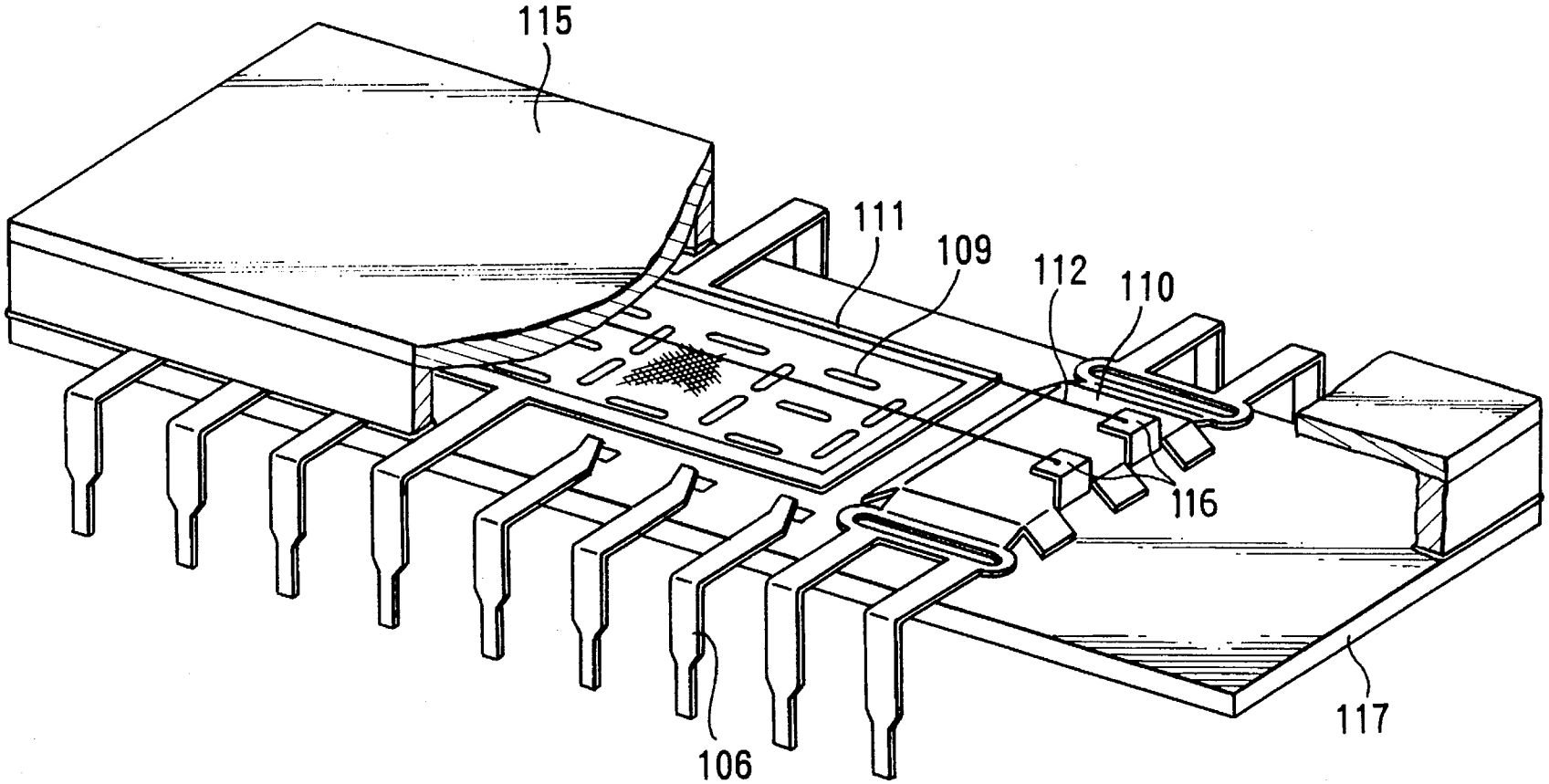
FIG. 1 is a partially cutaway perspective view showing a chip-in-glass fluorescent indicator panel according to the first embodiment of the present invention.
Figure 2:
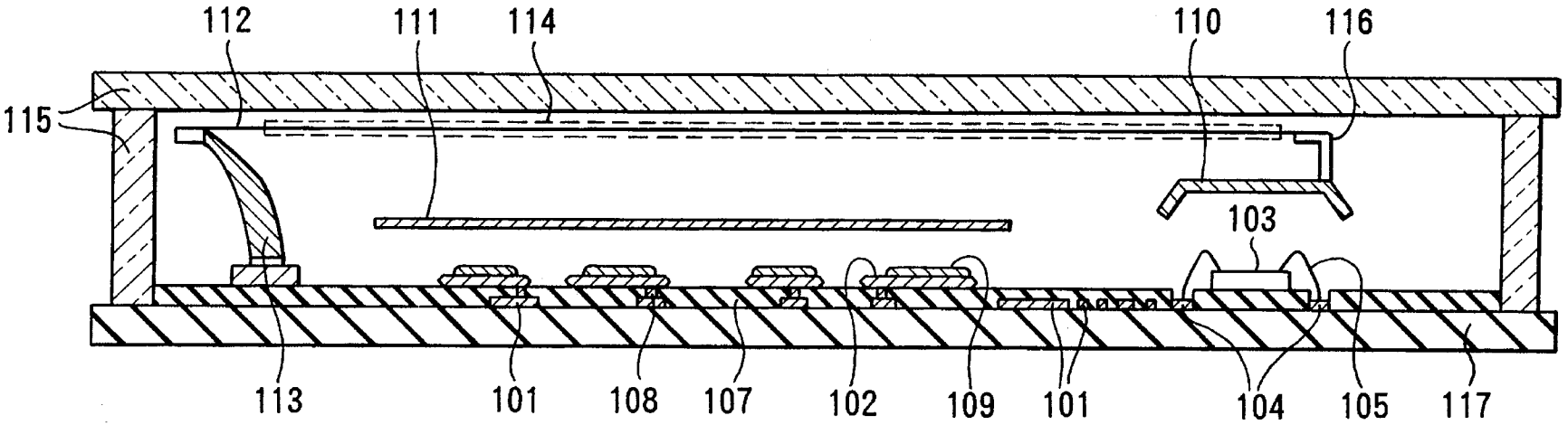
FIG. 2 is a sectional view showing the chip-in-glass fluorescent indicator panel in FIG. 1.

FIG. 1 shows a chip-in-glass fluorescent indicator panel according to the first embodiment of the present invention, and FIG. 2 shows the section of the chip-in-glass fluorescent indicator panel in FIG. 1.

According to the first embodiment, as shown in FIGS. 1 and 2, a wiring layer 101 formed by sputtering Al or printing Ag is formed on a glass substrate 117, and at least one insulating layer 107 is formed by printing on the wiring layer 101 to prevent a pattern-like graphite layer 102 from being unnecessarily short-circuited to the wiring layer 101. In the insulating layer 107, holes for electrically connecting the pattern-like graphite layer 102 and terminals 106 to the wiring layer 101 are formed. The holes for electrically connecting the pattern-like graphite layer 102 to the wiring layer 101 are filled with graphite 108. The pattern-like graphite layer 102 is formed by screen printing on the insulating layer 107. After the pattern-like graphite layer 102 is sintered, a phosphor layer 109 is formed on the pattern-like graphite layer 102 by screen printing, photolithography, or the like.

The IC 103 is mounted on the insulating layer 107 on which a die bonding material is coated, and the die bonding material is cured. The bonding pads on the IC 103 are connected to bonding pads 104 on the substrate by bonding wires 105. A filament 112 on which a coating layer 114 consisting of ternary carbonate is formed is suspended by an anchor 113 and a filament fixing portion 116 in the space above the IC 103, the phosphor layer 109, and a grid 111. The filament fixing portion 116 is formed on an IC shield 110 for protecting the IC 103 from hot electrons from the coating layer 114 of the filament 112. In order to easily fix the filament 112 to the anchor 113 and the filament fixing portion 116, the coating layer 114 is peeled to expose a core line at both the ends of the filament 112. These elements are assembled together with a glass envelope 115. The resultant structure is subjected to a sealing and evacuating processes to complete a chip-in-glass fluorescent indicator panel. Note that the filament fixing portion 116 may be integrated with the IC shield 110.

From an inspection of the drawings in general and FIG. 2 in particular, it should be apparent that the filament fixing portion 116 is shaped by bending an integral end portion of the IC shield 110 to form a U-shape formation with respect to the surface of the IC shield 110. The IC shield and the filament are arranged in parallel with the glass substrate 117.

Figure 3:
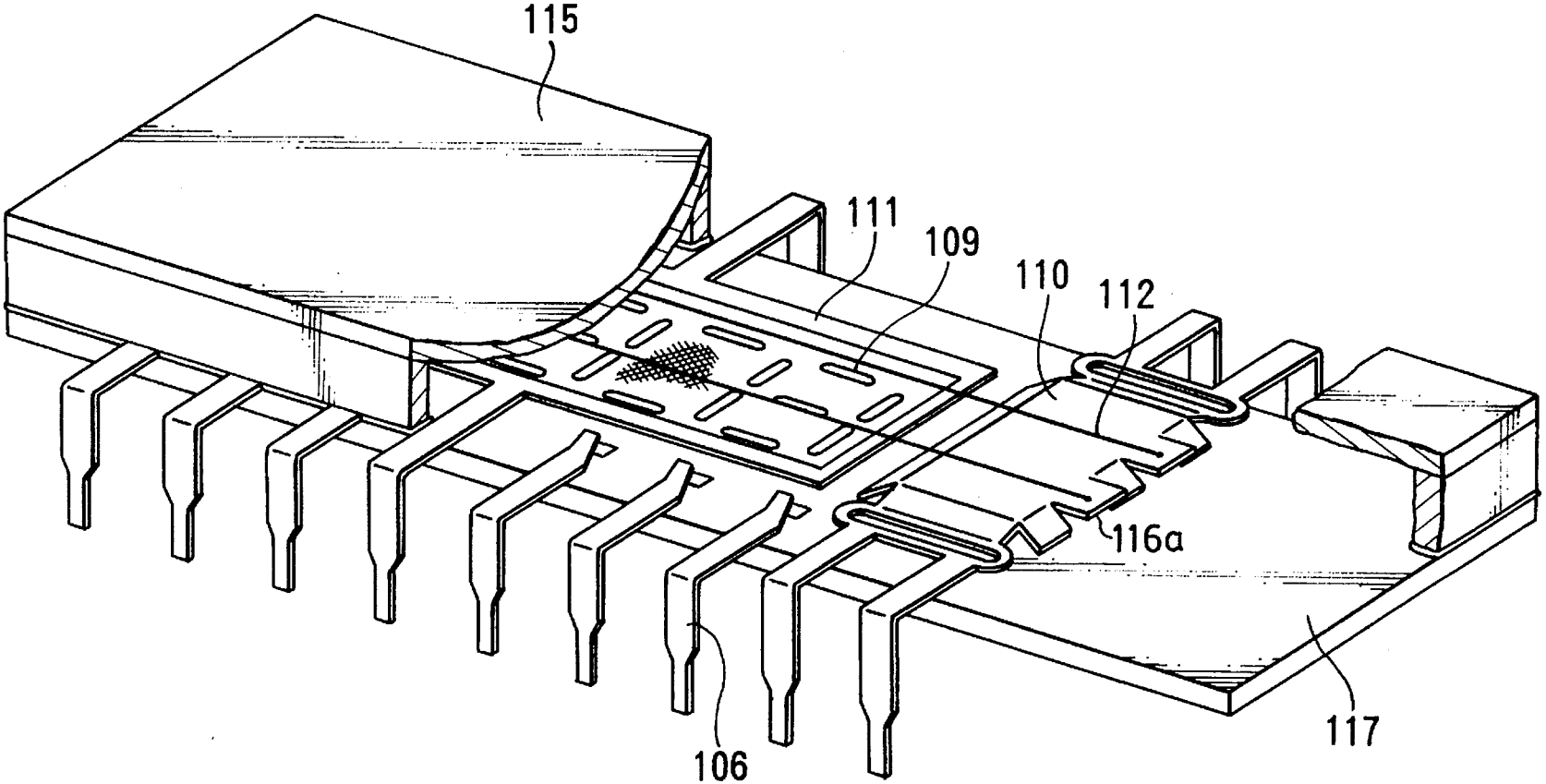
FIG. 3 is a partially cutaway perspective view showing a chip-in-glass fluorescent indicator panel according to the second embodiment of the present invention.
Figure 4:
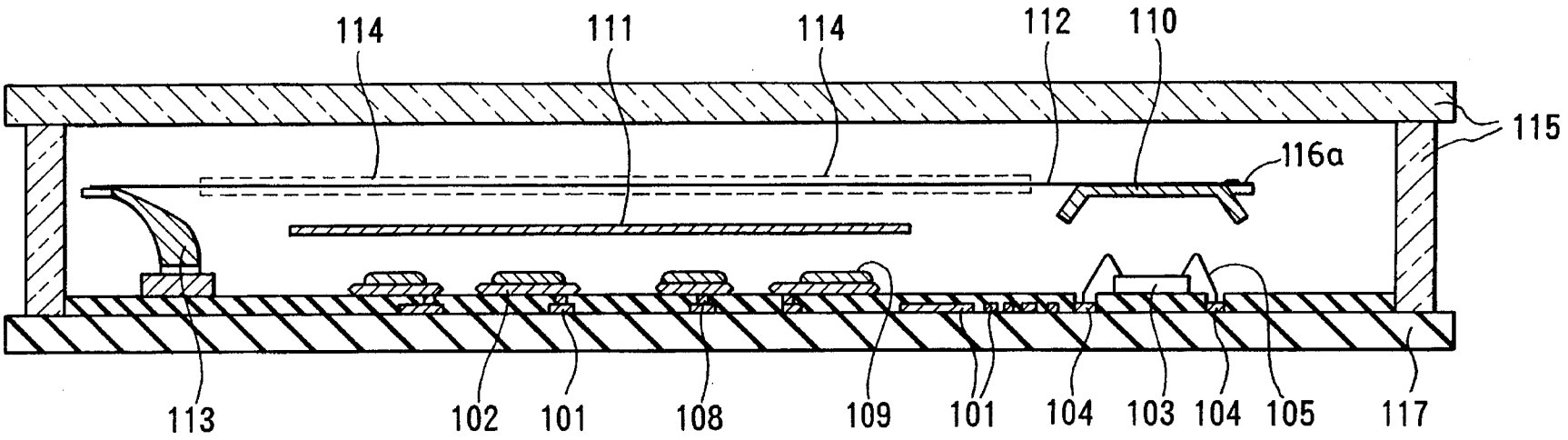
FIG. 4 is a sectional view showing the chip-in-glass fluorescent indicator panel in FIG. 3.
Figure 5:
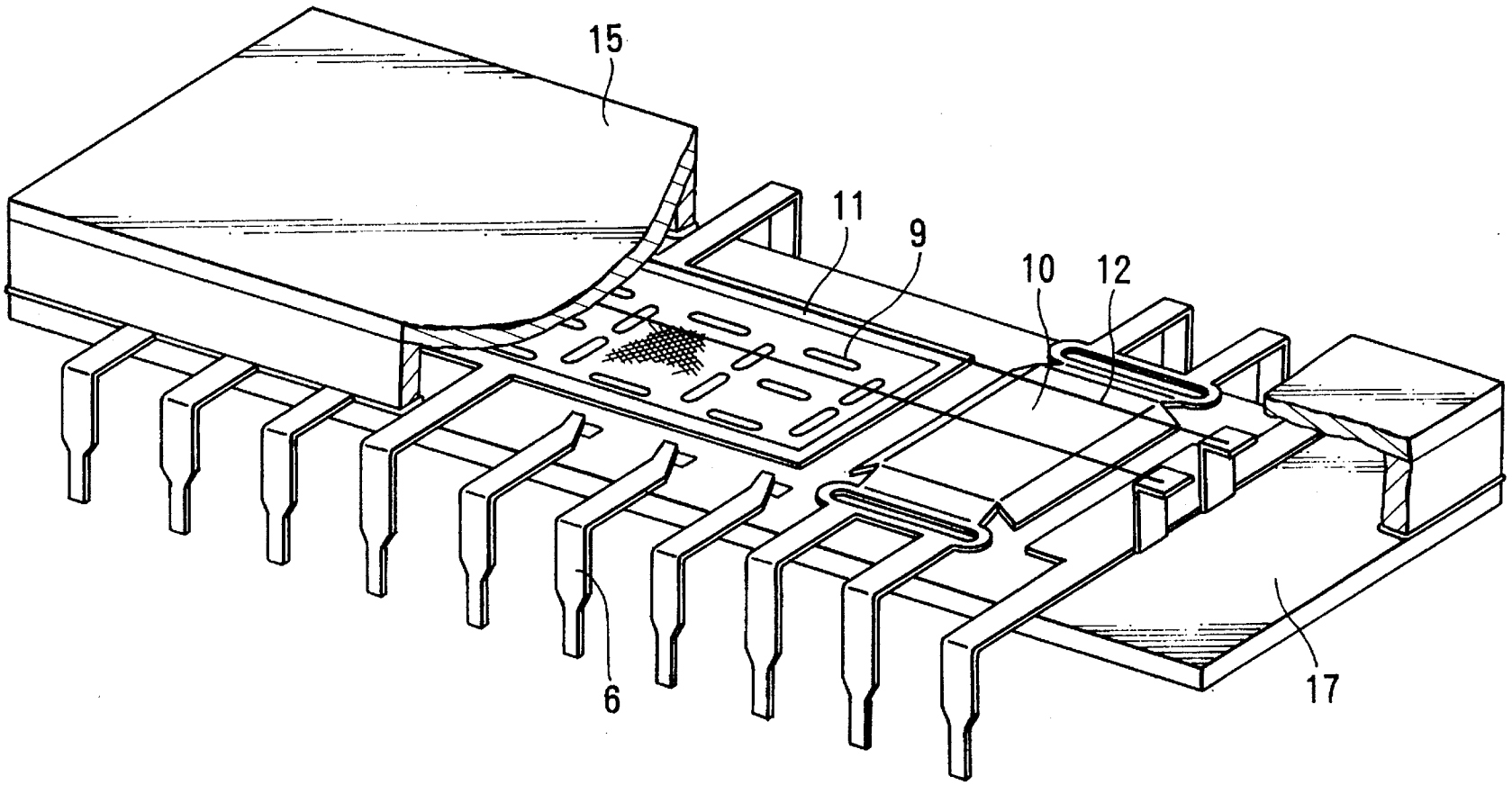
FIG.5 PRIOR ART
FIG. 5 is a partially cutaway perspective view showing a conventional chip-in-glass fluorescent indicator panel.
Figure 6:
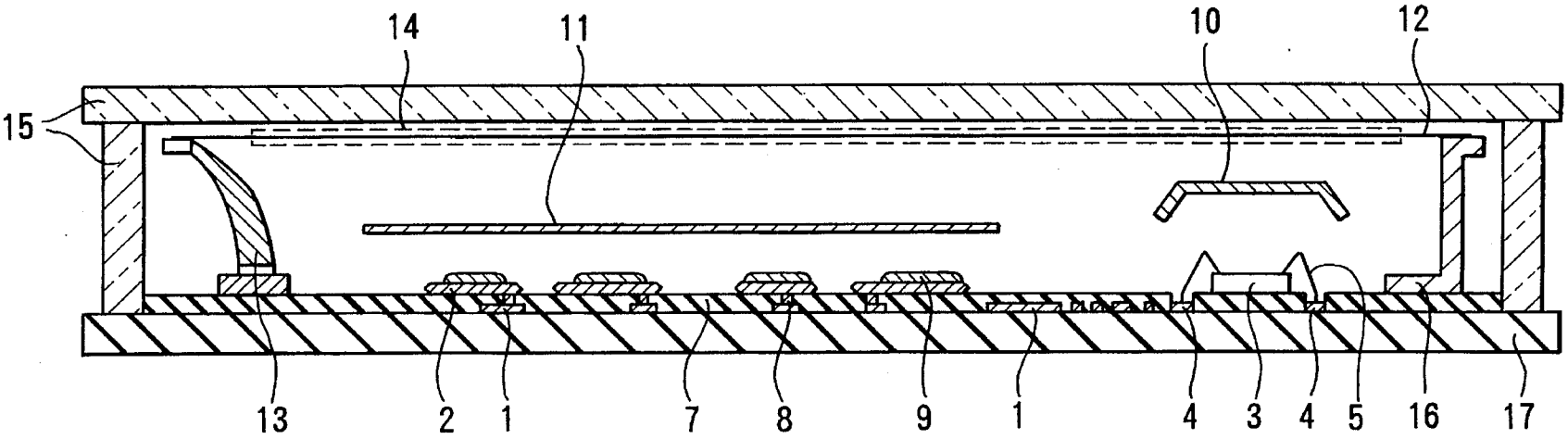
FIG.6 PRIOR ART
FIG. 6 is a sectional view showing the chip-in-glass fluorescent indicator panel in FIG. 5.

FIG. 3 shows a chip-in-glass fluorescent indicator panel according to the second embodiment of the present invention, and the FIG. 4 shows the section of the chip-in-glass fluorescent indicator panel in FIG. 3.

According to the second embodiment, as shown in FIGS. 3 and 4, the filament fixing portion 116 on the IC shield 110 in the first embodiment shown in FIGS. 1 and 2 is removed, and a filament 112 is directly fixed on an IC shield 110, at a point 116*a*. In this case, a coating layer 114 at a portion where the IC shield 110 is in contact with the filament 112 is pealed. In this manner, the height of the filament 112 smaller than that of the filament in the first embodiment can be obtained.

According to this embodiment, a high luminance can be obtained at a low voltage. The thickness of the package and the number of parts can be decreased.

As described above, according to the present invention, a filament fixing portion is formed on an IC shield formed between an IC and a filament to protect the IC from hot electrons emitted from the filament, so that the filament shorter than the filament of a conventional chip-in-glass fluorescent indicator panel by about 3 mm can be used. For this reason, a drive voltage of the filament can be suppressed to be lower than that of the conventional fluorescent indicator panel. Even when the filament is driven at a low DC voltage, e.g., an anode-grid voltage of 12V or less, an anode-grid RMS voltage is higher than that of the conventional fluorescent indicator panel, thereby advantageously assuring luminance higher than that of the conventional fluorescent indicator panel.

In addition, a filament fixing portion need not be formed outside the IC to advantageously decrease the size of the package.

What is claimed is:

1. A chip-in-glass fluorescent indicator panel comprising:

a glass substrate;

a wiring layer formed on said glass substrate;

an insulating layer covering said wiring layer;

a pattern-like graphite layer formed on said insulating layer and electrically connected to said wiring layer;

a phosphor layer formed on said pattern-like graphite layer;

a filament suspended above said phosphor layer with an interval;

a grid arranged between said filament and said phosphor layer;

an IC fixed on said insulating layer on one end side of said glass substrate and connected to said pattern-like graphite layer through said wiring layer;

an IC shield arranged between said IC and said filament, the IC shield being arranged in parallel with the glass substrate and the filament being suspended in parallel with the glass substrate;

a filament fixing portion which is an integrally formed part of said IC shield, the filament fixing portion being a bent tab portion of the IC shield; and an anchor, arranged on said insulating layer on the other end side of said glass substrate, for suspending said filament between said anchor and said filament fixing portion.

2. A panel according to claim 1, wherein the filament fixing portion is a U-shape formation with respect to the surface of the IC shield.

3. A panel according to claim 2 wherein the filament fixing portion is a shaped which is a bent notched portion of the IC shield, one end of the filament being fixed on an upper surface of the filament fixing portion and being arranged in parallel with the IC shield.

4. A chip-in-glass fluorescent indicator panel comprising:

a glass substrate;

a wiring layer formed on said glass substrate;

an insulating layer covering said wiring layer;

a pattern-like graphite layer formed on said insulating layer and electrically connected to said wiring layer;

a phosphor layer formed on said pattern-like graphite layer;

a filament suspended an interval above said phosphor layer, the filament being suspended in parallel with the glass substrate;

a grid arranged between said filament and said phosphor layer;

an IC fixed on said insulating layer on one end side of said glass substrate and connected to said pattern-like graphite layer through said wiring layer;

an IC shield arranged between said IC and said filament, the IC shield being arranged in parallel with the glass substrate, and one end of the filament being fixed on an upper surface of the IC shield; and an anchor, arranged on said insulating layer on the other end side of said glass substrate, for suspending said filament between said anchor and said IC shield.

* * * * *